US005511526A

United States Patent [19]

Hamburg et al.

[11] Patent Number: 5,511,526

[45] Date of Patent: Apr. 30, 1996

[54] ENGINE AIR/FUEL CONTROL WITH ADAPTIVE LEARNING

[75] Inventors: Douglas R. Hamburg, Bloomfield; Dennis C. Reed, Plymouth; Nicholas G. Zorka, Clarkston, all of Mich.

[73] Assignee: Ford Motor Company, Dearborn, Mich.

[21] Appl. No.: 497,274

[22] Filed: Jun. 30, 1995

[51] Int. Cl.[6] ..... F02D 41/14; F02P 5/15

[52] U.S. Cl. ..... 123/424; 123/674; 123/695

[58] Field of Search ..... 123/424, 672, 123/673, 674, 675, 679, 693, 694, 695, 696; 60/284, 285, 286

[56] References Cited

U.S. PATENT DOCUMENTS

| | | | |
|---|---|---|---|
| 4,132,199 | 1/1979 | Kuroiwa et al. | 123/701 |
| 4,228,775 | 10/1980 | Schweikert | 123/696 |
| 4,344,317 | 8/1982 | Hattori et al. | 123/693 |
| 4,350,130 | 9/1982 | Shulman | 123/696 |
| 4,483,300 | 11/1984 | Hosaka et al. | 123/673 |
| 4,494,374 | 1/1985 | Kitahara et al. | 123/695 |
| 5,211,011 | 5/1993 | Nishikawa et al. | 60/284 |
| 5,213,088 | 5/1993 | Harada | 123/674 |
| 5,315,823 | 5/1994 | Nishikawa et al. | 60/286 |
| 5,390,651 | 2/1995 | Nussbaum et al. | 123/694 |
| 5,392,599 | 2/1995 | Hamburg et al. | 60/274 |
| 5,396,875 | 3/1995 | Kotwicki et al. | 123/695 |
| 5,408,980 | 4/1995 | Doering et al. | 123/674 |
| 5,462,037 | 10/1995 | Hasegawa et al. | 123/673 |

FOREIGN PATENT DOCUMENTS

| | | |
|---|---|---|
| 54-108126 | 8/1979 | Japan . |
| 2-230934 | 9/1990 | Japan . |

*Primary Examiner*—Willis R. Wolfe
*Attorney, Agent, or Firm*—Allan J. Lippa; Roger L. May

[57] ABSTRACT

An air/fuel control system for an engine (28) provides an air/fuel indicating signal linearly related to average engine air/fuel operation from a two-state exhaust gas oxygen sensor (44). Fuel delivered to the engine is modulated with a periodic signal (144). Adaptive feedback control (steps 200–280) adaptively learns a desired amplitude for the periodic signal to generate the air/fuel indicating signal with desired sensitivity and operating range.

17 Claims, 7 Drawing Sheets

START
ADD MODSIG TO FV
200

READ AND STORE RPM, LOAD, ECT
202
DELAY
204
RPM LOAD, ECT +/- ΔI OF STORED VALUES?
206
N
Y
N +/- ΔI COMPARISONS ?
208
N
Y
MEASURE EGO FUND SWITCH FREQ (EGOF)
212
EGOF = MODSIG F?
214
N
Y
RPM LOAD, ECT +/- ΔI OF STORED VALUES ?
218
N
Y
INCREMENT MODSIGAMP
222
MODSIGAMP > LIMIT?
224
N
Y
GO TO DIAGNOSTICS
232
OPEN LOOP A/F CONTROL
230
READ AND STORE FILTERED EGO OUTPUT (EGO )
236
C
B

ENGINE AIR/FUEL CONTROL WITH ADAPTIVE LEARNING

BACKGROUND OF THE INVENTION

The field of the invention relates to engine control systems, including air/fuel and ignition control systems.

It is known to alternately deliver fuel to the engine rich and then lean while the converter is below a desired temperature. Retarding ignition timing to more rapidly heat engine exhaust gases and the catalytic converter coupled to the exhaust gases is also known. An example of such a system is shown in U.S. Pat. No. 5,211,011.

The inventors herein have recognized numerous problems with the above approaches. One problem is excessive modulation may result in engine misfires and diminished modulation may result in ineffective air/fuel control. Another problem is that in attempting to provide average air/fuel operation slightly lean of stoichiometry, actual air/fuel operation may be leaner than desired causing rough engine operation and increased emissions.

SUMMARY OF THE INVENTION

An object of the invention claimed herein is to provide an air/fuel control system responsive to a two-state exhaust gas oxygen sensor which is capable of running the engine accurately at any desired air/fuel ratio.

The problems of prior approaches are overcome, and the objects and advantages of the claimed invention achieved, by providing a control method for an engine having an exhaust gas oxygen sensor with a two-state output having first and second states respectively corresponding to exhaust gases being rich or lean of stoichiometry. In one particular aspect of the invention, the method comprises the steps of: modulating flow of fuel delivered to the engine with a modulation signal having a preselected peak amplitude; providing an air/fuel ratio indicating signal from an average of the sensor output; changing the fuel flow a predetermined amount to achieve a preselected offset in engine air/fuel ratio; and adjusting the modulation signal amplitude in response to a detection of when said air/fuel indicating signal exceeds a preselected value during the fuel flow changing step.

An advantage of the above aspect of the invention is that the amplitude of the modulating signal is adaptively learned or adjusted in response to a detection of when the indicated air/fuel ratio exceeds a preselected value. In this manner, problems of prior approaches such as the modulation amplitude being either too large or too small are avoided. Another advantage is that an indication of actual engine air/fuel ratio is provided.

In another aspect of the invention, the control system comprises: an exhaust gas oxygen sensor with a two state output having first and second states respectively corresponding to exhaust gases being rich or lean of stoichiometry; a fuel controller delivering fuel to the engine in response to a desired fuel signal; a controller modulating the desired fuel signal with a modulation signal having a preselected amplitude and averaging an output of the exhaust gas oxygen sensor to provide an air/fuel indicating signal having an amplitude related to engine air/fuel operation; reference means for providing a reference signal having a first reference value corresponding to an air/fuel ratio lean of stoichiometry during cold engine operation and a second reference value corresponding to a stoichiometric air/fuel ratio during warm engine operation; feedback means for integrating an error signal derived from a difference of said air/fuel indicating signal and the reference signal to generate a feedback variable, and correcting the delivered fuel with said feedback variable; and the controller offsetting the delivered fuel a predetermined amount to achieve a preselected rich offset in engine air/fuel ratio, the controller increasing the modulation signal amplitude in response to a detection of when the air/fuel indicating signal exceeds a preselected value during the offsetting step.

An advantage of the above aspect of the invention is that accurate air/fuel feedback control is provided to maintain the average air/fuel ratio at a precise lean value offset from stoichiometry.

BRIEF DESCRIPTION OF THE DRAWINGS

The object and advantages of the claimed invention will become more readily apparent from the following detailed example of operation described with reference to the drawings wherein:

DESCRIPTION OF AN EXAMPLE OF OPERATION

Figure 1:
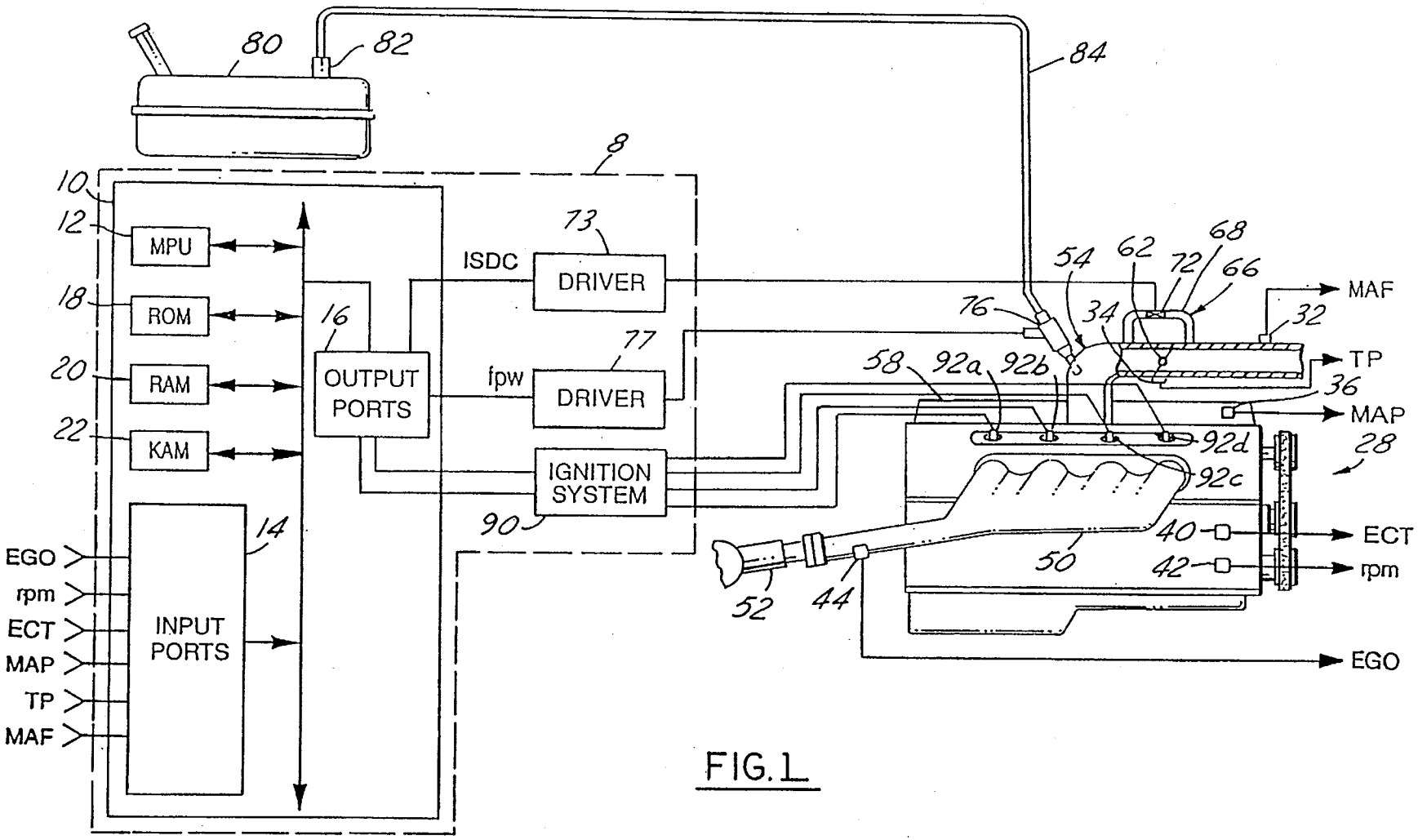
FIG. 1 is a block diagram of an embodiment in which the invention is used to advantage.

Controller 8 is shown in the block diagram of FIG. 1 including conventional microcomputer 10 having: microprocessor unit 12; input ports 14; output ports 16; read only memory 18, for storing control programs; random access memory 20, for temporary data storage which may also be used for counters or timers; keep-alive memory 22, for storing learned values; and a conventional data bus. As described in greater detail later herein, controller 8 controls operation of engine 28 by the following control signals; pulse width signal fpw for controlling liquid fuel delivery via drivers 77; idle speed duty cycle signal ISDC for controlling engine idle speed via drivers 73; and conventional distributorless ignition system 90 for providing ignition current to spark plugs 92*a–d*.

Controller 8 is shown receiving various signals from conventional engine sensors coupled to engine 28 including: measurement of inducted mass airflow (MAF) from mass airflow sensor 32; indication of primary throttle position (TP) from throttle position sensor 34; manifold absolute pressure (MAP), commonly used as an indication of engine load, from pressure sensor 36; engine coolant temperature (ECT) from temperature sensor 40; indication of engine speed (rpm) from tachometer 42; and output signal EGO from exhaust gas oxygen sensor 44 which, in this particular example, provides an indication of whether exhaust gases are either rich or lean of stoichiometric combustion.

In this particular example, engine 28 is shown having exhaust gas oxygen (EGO) sensor 44 coupled to exhaust manifold 50 upstream of conventional catalytic converter 52. Intake manifold 58 of engine 28 is shown coupled to throttle body 54 having primary throttle plate 62 positioned therein. Bypass throttling device 66 is shown coupled to throttle body 54 and includes; bypass conduit 68 connected for bypassing primary throttle plate 62; and solenoid valve 72 for throttling conduit 68 in proportion to the duty cycle of idle speed duty cycle signal ISDC from controller 8. Throttle body 54 is also shown having fuel injector 76 coupled thereto for delivering liquid fuel in proportion to the pulse width of signal fpw from controller 8. Fuel is delivered to fuel injector 76 by a conventional fuel system including fuel tank 80, fuel pump 82, and fuel rail 84.

Figure 2A:
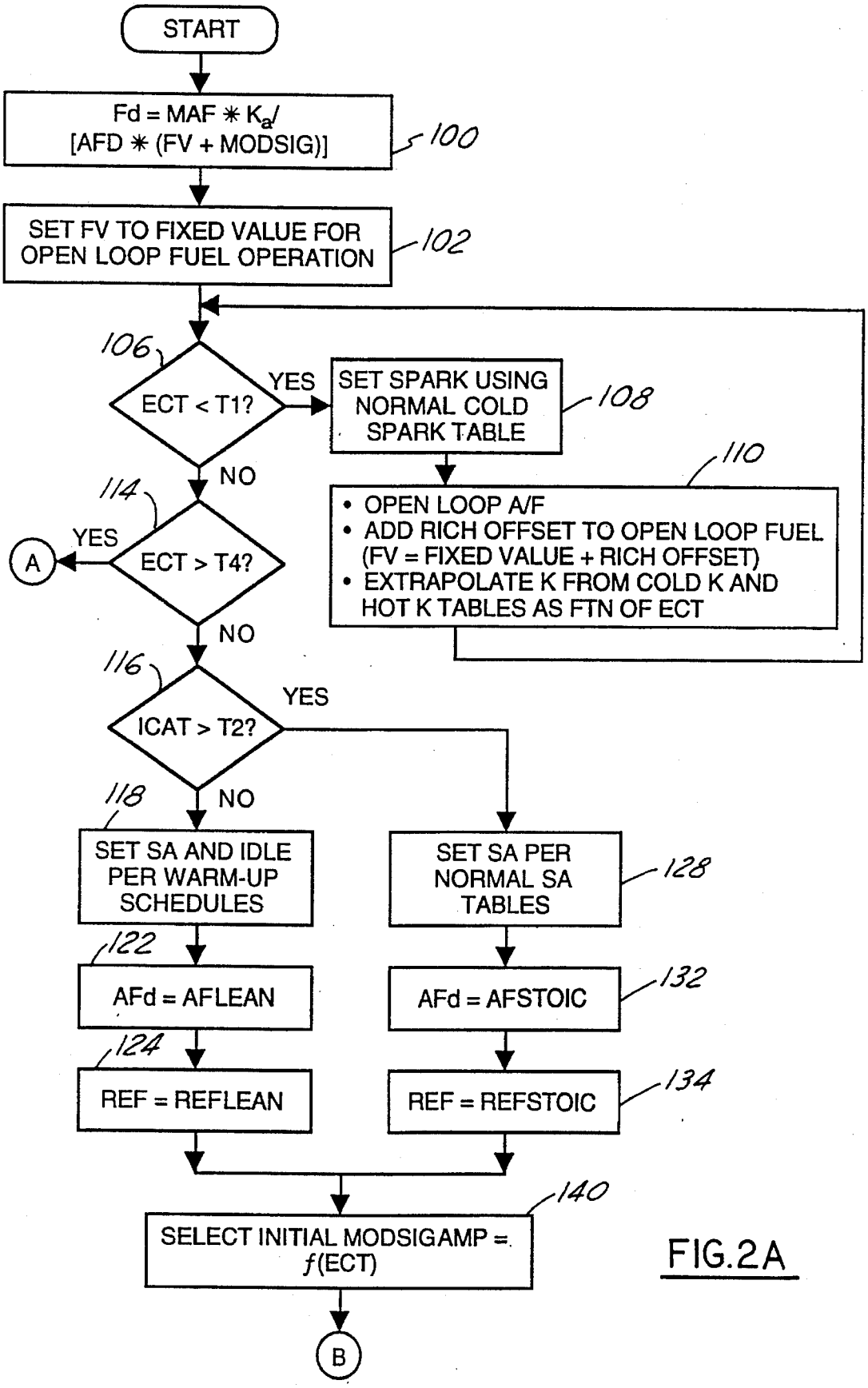
FIGS. 2A–2B are flow charts of various operations performed by portions of the embodiment shown in FIG. 1.
Figure 2B:
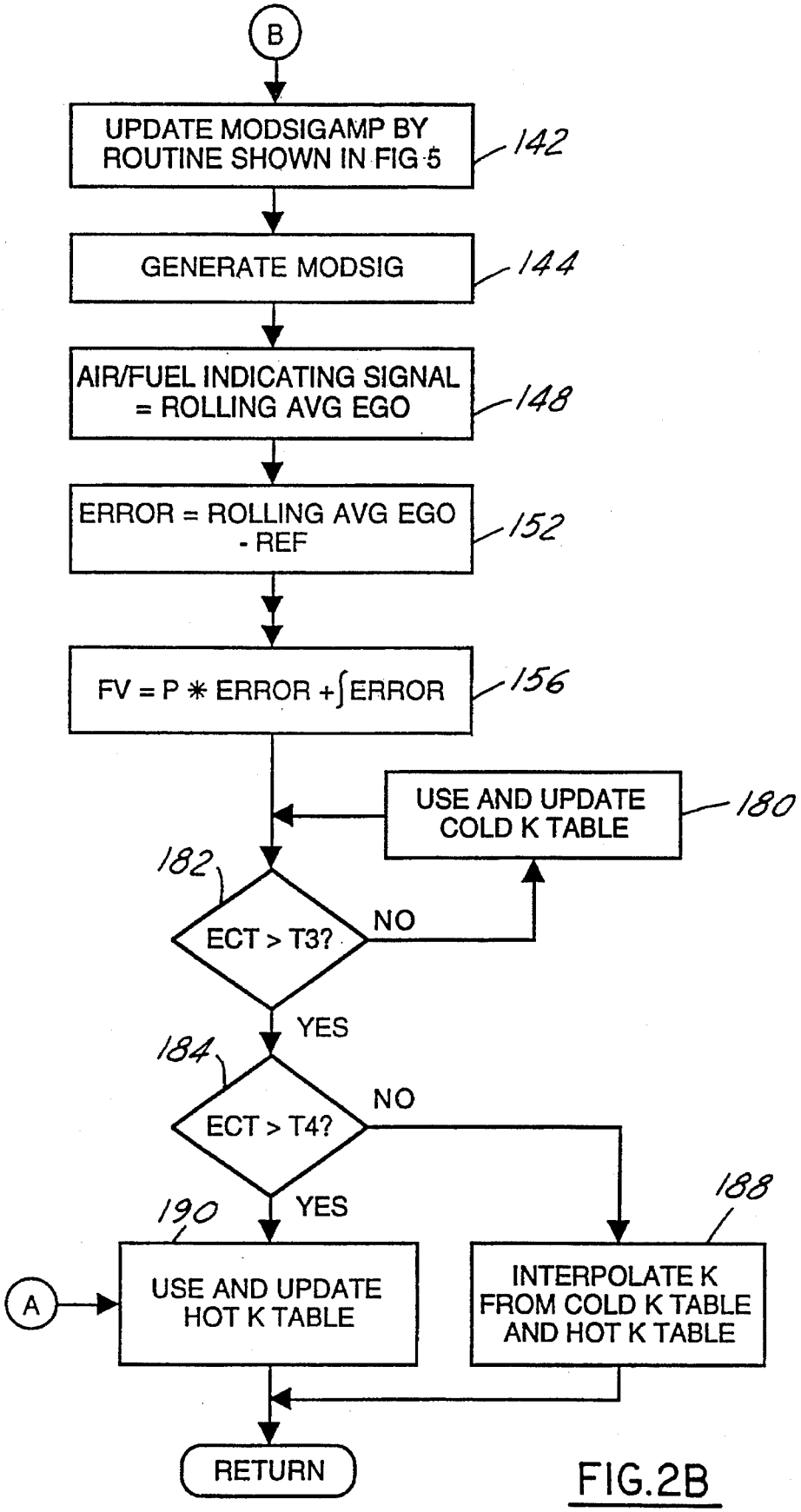

A description of various air/fuel operations performed by controller 8 is now described with initial reference to the flow charts shown in FIGS. 2A–2B. During step 100, the fuel command (shown as desired fuel quantity Fd) is calculated as shown. Desired fuel quantity Fd is first modulated by adding modulation signal MODSIG to Feedback variable FV. The generation of both feedback variable FV and modulation signal MODSIG are described later herein with reference to FIGS. 2A–2B. The sum of feedback variable FV and modulation signal MODSIG is then multiplied by AFD and divided into the product of inducted mass flow measurement MAF times correction value K to generate desired fuel quantity Fd. In this particular example, desired air/fuel ratio AFD is the stoichiometric value of the fuel blend used which is 14.3 pounds of air per pound of fuel for a low emissions fuel blend.

Continuing with FIGS. 2A–2B, feedback variable FV is initially set to a fixed value for open loop air/fuel operation (step 102). Stated another way, during open loop fuel control, desired fuel quantity Fd is related to signal MAF and is not adjusted by feedback control. In this particular example, feedback variable FV is set to unity which would correspond to operation at desired air/fuel ratio AFD under ideal operating conditions without any engine component aging. It is well known, however, that this open loop operation may not result in engine air/fuel operation exactly at stoichiometry. Correction by correction value K, however, will be provided as described below.

Engine temperature is too low to enter the subroutine for converter warm-up when engine coolant temperature ECT is less than predetermined temperature T1 (step 106). The subroutine described with reference to steps 108–110 is then entered to minimize the time required to warm-up engine 28. In step 108, ignition timing is first set using the cold start table stored in microcomputer 10. Various sub steps are then performed during step 110. Feedback variable FV is set to a fixed value less than unity to provide a rich offset to desired fuel quantity Fd, during open loop air/fuel operation. Correction value K is then extrapolated from two tables stored in controller 8. These two tables store correction K for cold engine operation and hot engine operation, respectively. In this example, the extrapolation occurs as a function of engine coolant temperature ECT.

In the event engine coolant temperature ECT is greater than temperature T1 (step 106), it is compared to temperature T4 (step 114) which is associated with hot engine operation and normal air/fuel ratio control. If engine coolant temperature ECT is less than temperature T4, an inference of the temperature of catalytic converter 52 (ICAT) is compared to temperature T2 (step 116).

When inferred temperature ICAT is less than temperature T2, ignition timing and engine idle speed are set per the warm-up schedules (step 118) provided for rapid catalyst warm-up. That is, ignition timing is retarded from its nominal value and idle speed elevated. Desired engine air/fuel ratio AFd is set to a lean value (AFLEAN) which is lean of stoichiometry by a preselected amount as shown in step 122. In this particular example, AFLEAN is 14.6 pounds of air per pound of fuel. During step 124, reference signal REF is set equal to lean value REFLEAN which corresponds to desired lean air/fuel ratio AFLEAN.

On the other hand, if inferred temperature ICAT is greater than temperature T2, normal ignition timing and idle speed tables are utilized (step 128). Desired air/fuel ratio AFd is then set equal to the air/fuel ratio corresponding to stoichiometry (AFSTOIC) as shown in step 132. During step 134, reference signal REF is set equal to a value corresponding to the stoichiometric air/fuel ratio (REFSTOIC).

Modulation signal MODSIG is generated during steps 140–144 as a triangular wave. The amplitude of MODSIG (MODSIGAMP) is initially set as a function of engine coolant temperature ECT during step 140. As described in greater detail later herein with particular reference to FIGS. 5A–55, amplitude MODSIGAMP is updated by an adaptively learned value (step 142). Stated another way, amplitude MODSIGAMP is corrected by the feedback routine described later herein with particular reference to FIGS. 5A–55.

A rolling average of signal EGO is generated during step 148. Error signal ERROR is generated during step 152 by subtracting reference signal REF from the rolling average of signal EGO (152). The feedback variable FV is then generated by applying a proportional plus integral (PI) controller to signal ERROR as shown in step 156. More specifically, signal ERROR is multiplied by proportional gain value P and the product added to the integral of signal ERROR.

The operation and advantageous effects of steps 122–156 will be better understood by reviewing an example of operation with particular reference to the waveforms shown in FIGS. 3A–3E. Before discussing FIGS. 3A–3E, the description of updating the cold K and hot K tables is completed with continuing reference to FIG. 2B.

When engine coolant temperature ECT is greater than temperature T3 (step 182), but less than temperature T4 (step 184), each correction value K is interpolated from the cold K and hot K tables stored in microcomputer 10 for each engine speed load range (step 188). Otherwise, each correction value K is selected from the cold K table of microcomputer 10 (step 180). In the event engine coolant temperature ECT is greater than temperature T4 (step 184), each correction value K is selected from the hot K table of microcomputer 10 (step 190).

Figure 3A:
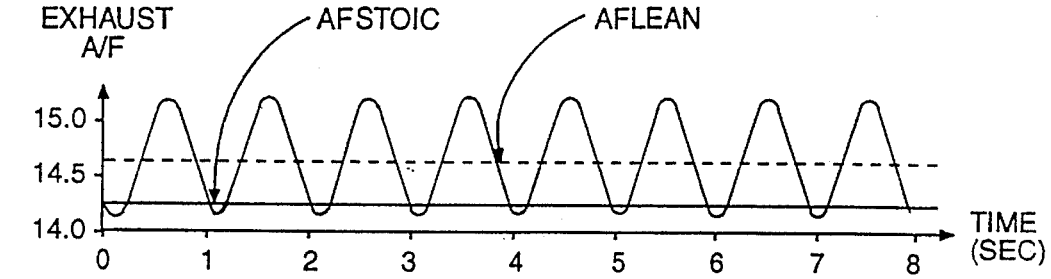
FIGS. 3A–3E illustrate various electrical waveforms corresponding to various operations performed by the embodiment shown in FIG. 1 with particular reference to the operation described with particular reference to FIGS. 2A–2B.
Figure 3B:
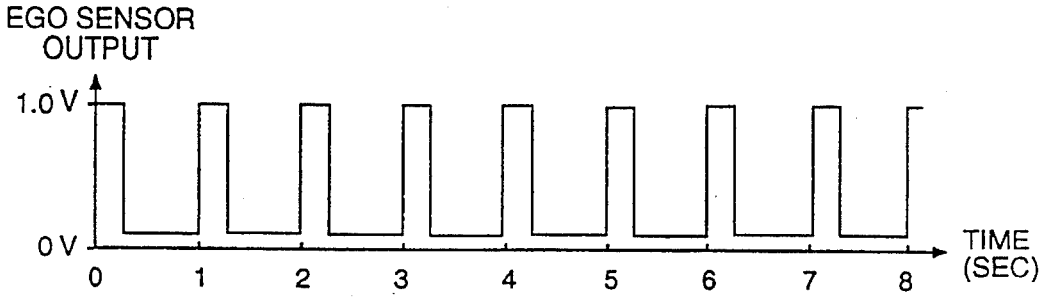
Figure 3C:
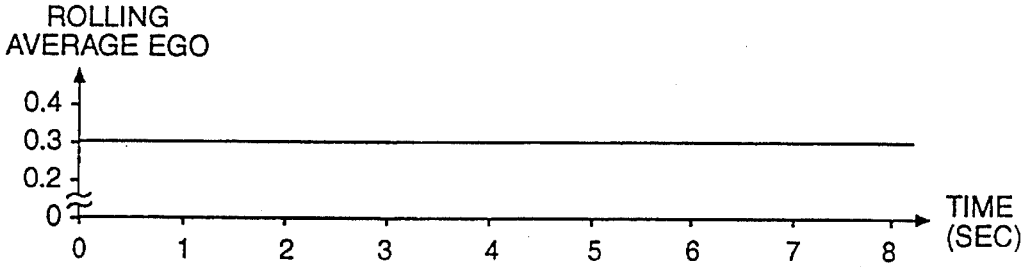
Figure 3D:
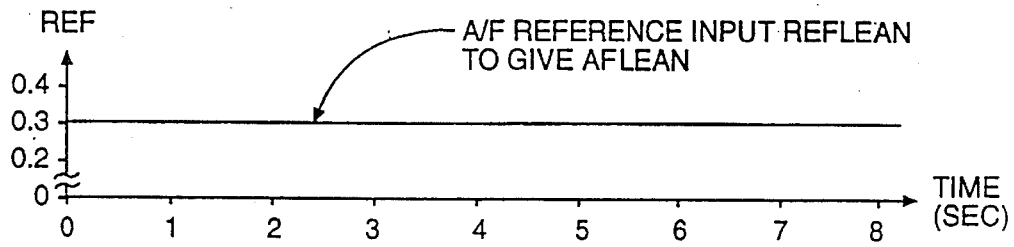
Figure 3E:
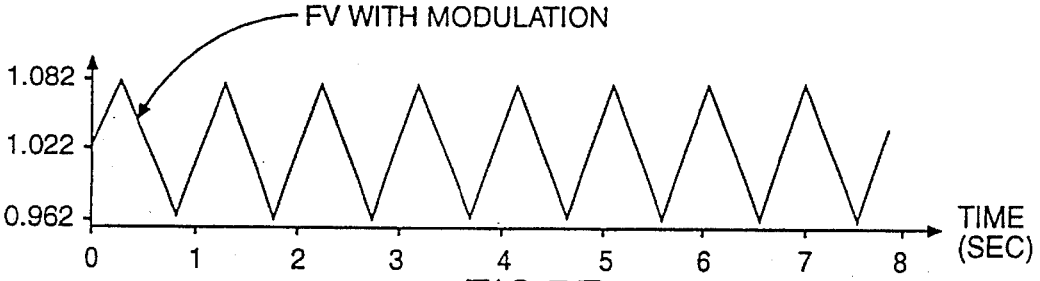

Referring now to FIGS. 3A–3E, and FIG. 4, graphical representations are shown which correspond to previously described process steps 122–156. In this particular example which depicts steady state lean air/fuel operation, reference signal REF is set to lean value REFLEAN (see FIG. 3D) to provide an average air/fuel ratio lean of stoichiometry. Concurrently, feedback variable FV is modulated with a triangular wave (FIG. 3E). Such modulation occurs until an indication is provided that catalytic converter 52 has reached a desired temperature.

In this particular example, the effect of such modulation and selection of lean reference value REFLEAN provides the exhaust air/fuel ratio shown in FIG. 3A. The average value of this air/fuel ratio is shown as the dashed line labeled AFLEAN which is lean of the stoichiometric air/fuel ratio (shown as labeled AFSTOIC). The modulation and lean air/fuel offset results in signal EGO from sensor 44 as shown in FIG. 3B. A high voltage state of signal EGO is indicative of air/fuel operation rich of stoichiometry and a low voltage state is indicative of air/fuel operation lean of stoichiometry.

The rolling average of signal EGO, which is the air/fuel indicating signal, is shown in FIG. 3C. In this example showing steady state operation, the rolling average of signal EGO (FIG. 3C) is forced to the same value as lean reference value REFLEAN (FIG. 3D).

Figure 4:
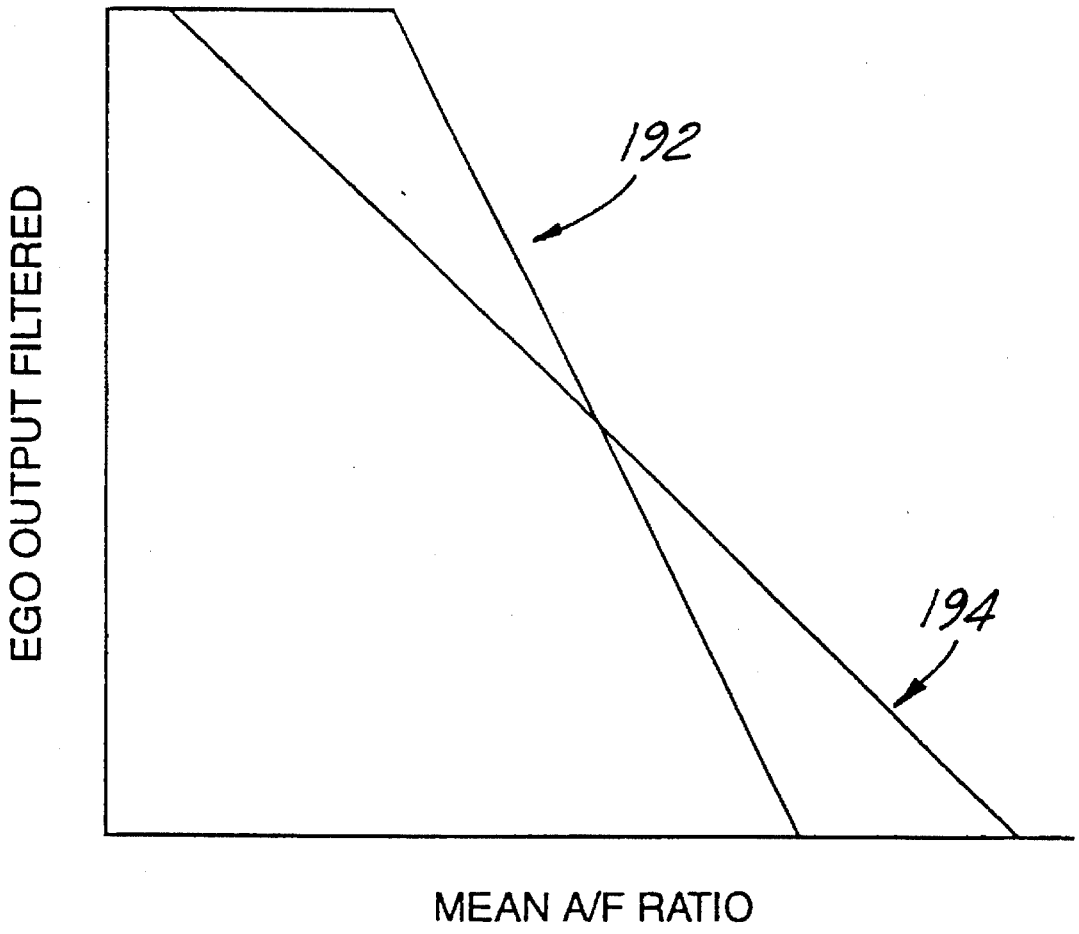
FIG. 4 is a graphical representation showing two average air/fuel indicating signals for different peak-peak amplitudes of the modulation signal.
Figure 5A:
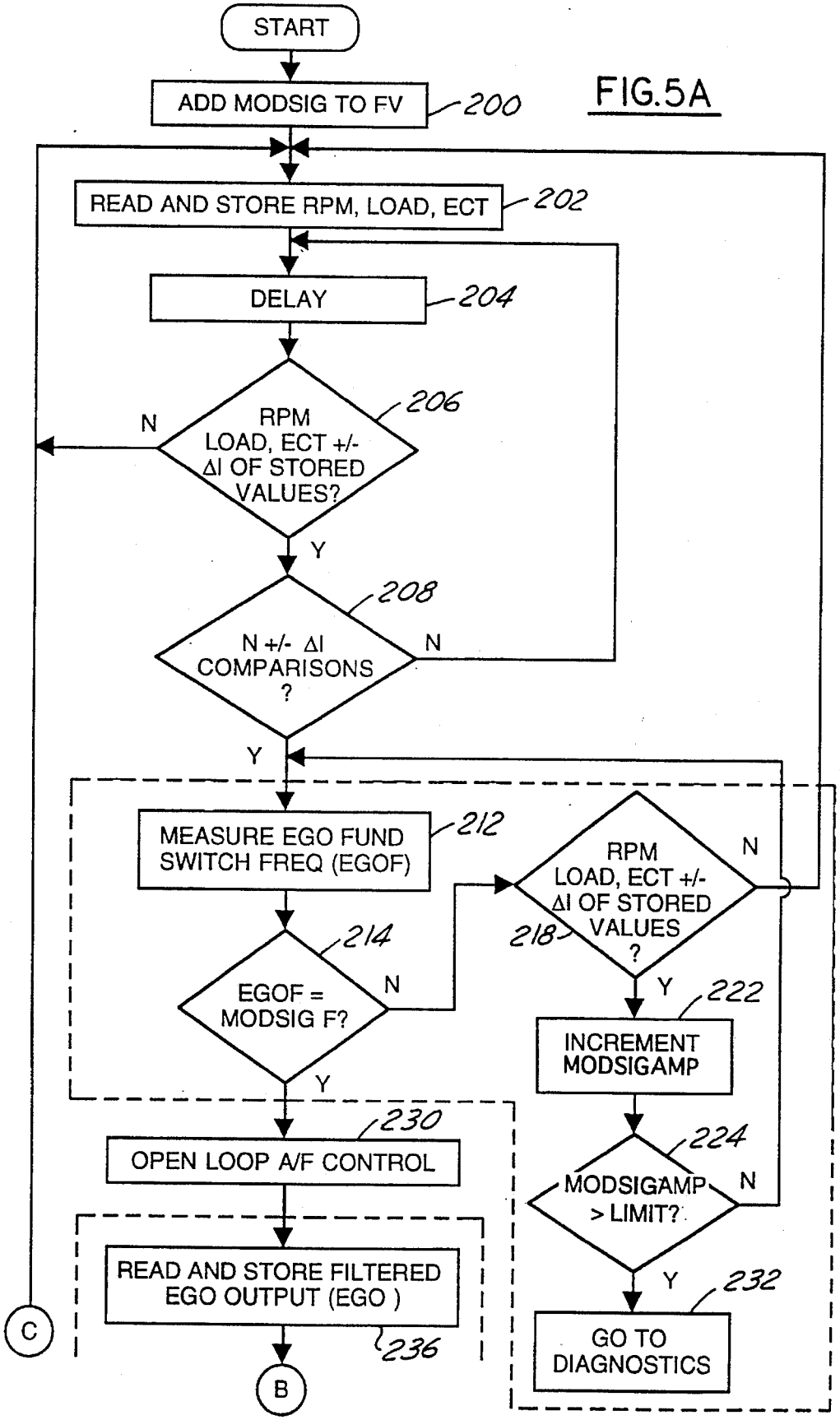
FIGS. 5A–5B show a flow chart of various operations performed by portions of the embodiment shown in FIG. 1.
Figure 5B:
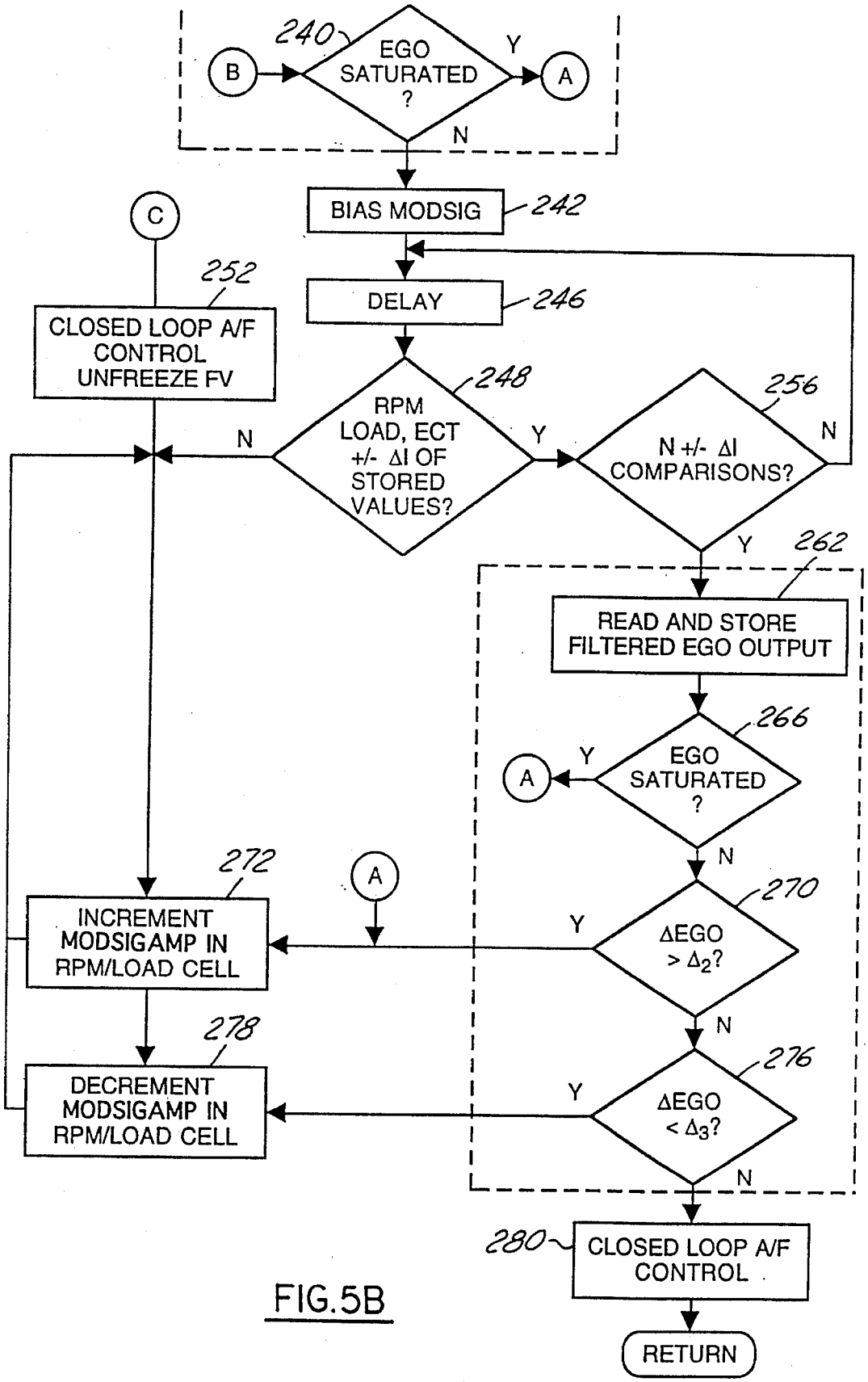

Referring to FIG. 4, two hypothetical graphical representations of the rolling average of signal EGO in relation to the average engine air/fuel ratio are shown by lines 192 and 194. As explained previously herein with particular reference to FIGS. 2–B and 3–C, the rolling average of signal EGO is the air/fuel indicating signal. In the particular example shown in FIG. 4, line 192 represents the air/fuel indicating signal from a control system in which modulating signal amplitude MODSIGAMP is approximately one-half of the peak to peak value of the modulating signal amplitude corresponding to the air/fuel indicating signal shown in line 194. As seen in FIG. 4, the air/fuel indicating signal associated with line 192 has appreciably greater sensitivity to a change in air/fuel ratio than does the air/fuel indicating signal associated with line 194. The differences in sensitivity of the air/fuel indicating signals caused by the variations in the modulating amplitude of signal MODSIG are used to advantage in the control system now described with particular reference to FIGS. 5A–5B.

An adaptive learning system is now described which adjusts the modulating amplitude of signal MODSIG via feedback control to achieve a desired sensitivity in the air/fuel indicating signal. As shown in step 200, modulating signal MODSIG is added to feedback variable FV thereby modulating desired fuel signal Fd and, accordingly, fuel delivered to engine 28 (see step 100 of FIG. 2A). Engine RPM, LOAD, and engine coolant temperature ECT are subsequently read and stored during step 202. After a delay time is provided in step 204, engine RPM, LOAD, and temperature ECT are checked during step 206 to see if they are within plus or minus Δ1 of the values previously stored in step 202. When engine RPM, LOAD, and temperature ECT are within plus or minus Δ1 for "N" successive comparisons, an indication of engine steady state operation is provided and the subroutine continues as described below (step 208).

During step 212, the fundamental switching frequency (EGOF) of EGO sensor 44 is measured. If frequency EGOF is not substantially equal to the switching frequency of signal MODSIG (step 214), and engine RPM, LOAD, and temperature ECT remain within plus or minus Δ1 of previously stored values (step 218), amplitude MODSIGAMP is incremented in step 222. This increment is provided because the low frequency switching of signal EGO was probably caused by an insufficient amplitude of modulating signal MODSIG.

When amplitude MODSIGAMP is less than limited value LIMIT (step 224), the above described frequency monitoring continues until switching frequency EGOF is equal to the switching frequency of signal MODSIG (step 214). Open loop air/fuel control then commences in step 230. Feedback variable FV is forced to its last value and the proportional plus integral controller previously described with reference to FIGS. 2A–2B for generating feedback variable FV is discontinued until closed loop air/fuel feedback control is resumed.

If amplitude MODSIGAMP is greater than limited value LIMIT (step 224), it signifies that a malfunction may exist, and a diagnosis action is taken (step 232).

The output of EGO sensor 44 is filtered and stored during step 236. If this output is saturated (step 240), at either a high or a low voltage output, the amplitude of modulation signal MODSIG is incremented step 272). If the output of EGO sensor 44 is not saturated, the subroutine continues with step 242.

Modulating signal MODSIG is biased or offset in either a rich or a lean air/fuel direction (step 242). In the particular example presented herein, modulation signal MODSIG is offset in a rich air/fuel direction by a predetermined bias amount. After a delay time provided in step 246, engine RPM, LOAD, and temperature ECT are checked to see if they are within plus or minus Δ1 of previously stored values (step 248). If they are not within previously stored values, closed loop air/fuel control is reinitiated (Step 252) by again generating feedback variable FV from the previously described proportional plus integral controller. The subroutine described herein is then reinitiated (step 202).

On the other hand, when engine RPM, LOAD and temperature ECT are within plus or minus Δ1 of previously stored values for "N" successive comparisons (steps 248, 256), the subroutine continues. The filtered output of EGO sensor 44 is again stored and compared to see if it is saturated high or low during steps 262 and 266. As described above with particular reference to steps 236 and 240, the amplitude of modulating signal MODSIG is incremented during step 272 in the event the output of EGO sensor 44 is saturated.

During steps 270–278, the difference in output of EGO sensor 44 is generated between two successive times to provide difference signal Δ EGO. In the event difference signal Δ EGO is greater than the value of Δ2 (step 270), the amplitude of signal MODSIG is incremented for the engine RPM and LOAD storage cell in which engine 28 is currently operating (step 272). Amplitude MODSIGAMP is increased under these conditions because it is apparent that there is too much sensitivity in the air/fuel indicating signal. Stated another way, the air/fuel indicating signal does not have a sufficient range of authority. As previously described herein, with particular reference to FIG. 4, the sensitivity of the air/fuel indicating signal is decreased by incrementing the amplitude of modulating signal MODSIG.

On the other hand, when difference signal Δ EGO is less than value Δ3 (step 276), where value Δ3 is less than value Δ2, the amplitude of modulating signal MODSIG is decremented in step 278. Decrementing amplitude MODSIGAMP occurs because increased sensitivity of the air/fuel indicating signal is desired. Referring briefly back to FIG. 4, the above-described adaptive learning process may be viewed as generating an air/fuel indicating signal between lines 192 (where sensitivity is too high), and line 194 (where sensitivity is too low). In this manner, amplitude MODSIGAMP is generated using the aforesaid feedback control to provide a desired sensitivity and range of authority for the air/fuel indicating signal. And, an air/fuel indicating signal generated as described herein above provides an accurate indication of engine air/fuel ratio from a two-state exhaust gas oxygen sensor. Controller 8 thereby accurately controls the engine air/fuel ratio at any desired value.

Although one example of an embodiment which practices the invention has been described herein, there are numerous other examples which could also be described. For example, analog devices, or discreet IC's may be used to advantage rather than a microcomputer. The invention is therefore to be defined only in accordance with the following claims.

What is claimed:

1. A control method for an engine having an exhaust gas oxygen sensor with a two state output having first and second states respectively corresponding to exhaust gases being rich or lean of stoichiometry, comprising the steps of:

modulating flow of fuel delivered to the engine with a modulation signal having a preselected peak amplitude;

providing an air/fuel ratio indicating signal from an average of the sensor output;

changing said fuel flow a predetermined amount to achieve a preselected offset in engine air/fuel ratio; and adjusting said modulation signal amplitude in response to a detection of when said air/fuel indicating signal exceeds a preselected value during said fuel flow changing step.

2. The control method recited in claim 1 wherein said fuel flow changing step offsets said air/fuel ratio in a rich direction to achieve a preselected rich offset.

3. The control method recited in claim 1 wherein said adjusting step increases said modulation signal amplitude a predetermined amount in response to said detection of when said air/fuel indicating signal exceeds a preselected value during said fuel flow changing step.

4. The control method recited in claim 3 further comprising the steps of decreasing said modulation signal amplitude in response to a detection of when said air/fuel indicating signal is less than a predetermined value during said fuel flow changing step, said predetermined value being less than said preselected value.

5. The control method recited in claim 1 wherein said fuel flow changing step offsets said air/fuel ratio in a lean direction to achieve a preselected lean offset.

6. The control method recited in claim 1 further comprising the step of generating an error signal from a difference between an average of the sensor output and a reference value related to a desired air/fuel ratio.

7. The control method recited in claim 6 further comprising the steps of generating a feedback variable from said error signal and correcting said fuel flow with said feedback variable.

8. The method in claim 6 wherein said step of providing said air/fuel ratio indicating signal further comprises a step averaging said error signal.

9. A control method for an engine having an exhaust gas oxygen sensor with a two state output having first and second states receptively corresponding to exhaust gases being rich or lean of stoichiometry, comprising the steps of:

modulating fuel flow delivered to the engine with a modulation signal having a preselected amplitude;

averaging the exhaust gas oxygen sensor output to provide an air/fuel indicating signal having an amplitude related to engine air/fuel operation;

generating an error signal from a difference between said air/fuel indicating signal and a reference signal;

generating a feedback variable from said error signal;

correcting said delivered fuel with said feedback variable;

biasing said modulation signal a predetermined amount to achieve a preselected offset in engine air/fuel ratio; and adjusting said modulation signal amplitude in response to a detection of when said air/fuel indicating signal exceeds a preselected value during said biasing step.

10. The control method recited in claim 9 further comprising a step of freezing said feedback variable during said biasing step.

11. The control method recited in claim 9 wherein said reference signal is provided with a first reference value corresponding to a desired air/fuel ratio lean of stoichiometry during cold engine operation and a second reference value corresponding to a stoichiometric air/fuel ratio.

12. The control method recited in claim 11 further comprising a step of retarding engine ignition timing from a nominal value during said cold engine operation to increase exhaust gas temperature during said cold engine operation.

13. The control method recited in claim 12 wherein said adjusting step increases said modulation signal amplitude a predetermined amount in response to said detection of when said air/fuel indicating signal exceeds a preselected value during said biasing step.

14. A control system for an engine, comprising:

an exhaust gas oxygen sensor with a two state output having first and second states respectively corresponding to exhaust gases being rich or lean of stoichiometry;

a fuel controller delivering fuel to the engine in response to a desired fuel signal;

a controller modulating said desired fuel signal with a modulation signal having a preselected amplitude and averaging an output of said exhaust gas oxygen sensor to provide an air/fuel indicating signal having an amplitude related to engine air/fuel operation;

reference means for providing a reference signal having a first reference value corresponding to an air/fuel ratio lean of stoichiometry during cold engine operation and a second reference value corresponding to a stoichiometric air/fuel ratio during warm engine operation;

feedback means for integrating an error signal derived from a difference said air/fuel indicating signal and said reference signal to generate a feedback variable, and correcting said delivered fuel with said feedback variable; and said controller offsetting said delivered fuel a predetermined amount to achieve a preselected rich offset in engine air/fuel ratio, said controller increasing said modulation signal amplitude in response to a detection of when said air/fuel indicating signal exceeds a preselected value during said offsetting step.

15. The control system recited in claim 14 further comprising an ignition controller for providing engine ignition timing retarded from a nominal value during said cold engine operation to increase exhaust gas temperature during said cold engine operation.

16. The control system recited in claim 14 wherein said controller provides a modulating signal for modulating said desired fuel signal.

17. The control system recited in claim 14 wherein said controller initially provides said modulating signal with an amplitude related to engine temperature.

* * * * *